United States Patent [19]

Scouten

[11] Patent Number: 4,745,696

[45] Date of Patent: May 24, 1988

[54] VISUAL MARKER FOR USE IN INDICATING OR IDENTIFYING ROLLED DRAWINGS OR THE LIKE

[76] Inventor: Raymond E. Scouten, 145 Montrose Street, Winnipeg, Manitoba, Canada, R3M 3L8

[21] Appl. No.: 921,482

[22] Filed: Oct. 22, 1986

[30] Foreign Application Priority Data

Oct. 25, 1985 [CA] Canada ..... 493861
Nov. 7, 1985 [CA] Canada ..... 494857

[51] Int. Cl.[4] ..... G09F 3/00

[52] U.S. Cl. ..... 40/309; 40/22; 40/623

[58] Field of Search ..... 40/10, 22, 309, 623

[56] References Cited

U.S. PATENT DOCUMENTS

| | | | |
|---|---|---|---|
| 304,071 | 8/1884 | Buck | 40/309 |
| 1,053,380 | 2/1913 | Gray et al. | 40/309 |
| 1,415,488 | 5/1922 | Seyfarth | 40/309 |
| 1,858,410 | 12/1929 | Morey | 40/309 |
| 1,865,908 | 7/1932 | Hengst | 40/309 |
| 4,471,547 | 9/1984 | Koslow | 40/309 |

*Primary Examiner*—Gene Mancene
*Assistant Examiner*—Wenceslao J. Contreras
*Attorney, Agent, or Firm*—Adrian D. Battison; Stanley G. Ade; Murray E. Thrift

[57] ABSTRACT

A visual marker for indicating or identifying rolled drawings provides a marker member in the form of a flat disc with a boss on a rear surface of the disc. A wire loop has ends turned inwardly for receipt as a press-fit in a slot defined in the boss. The ends define an axis which can rotate within the slot so that a front face of the disc can either be positioned at right angles to the plane of the loop for presenting axially from the end of the rolled drawing or substantially in the plane of the loop for facing upwardly when the loop is positioned horizontally between planar sheet or, for example, a stack of paper.

6 Claims, 1 Drawing Sheet

VISUAL MARKER FOR USE IN INDICATING OR IDENTIFYING ROLLED DRAWINGS OR THE LIKE

This invention relates to a visual marker for use in indicating or identifying rolled drawings or the like.

In offices where large numbers of drawings are produced, these are often stored on shelves in rolled form. In order to reduce the amount of storage space required, large numbers of drawings must be stored in a relatively small space and thus it is difficult to identify or separate one drawing from another since each effectively appears as a tube generally without visual identification available for ready inspection.

Devices generally suitable for this purpose have previously been proposed. U.S. Pat. No. 279,192 (Shepherd et al) discloses a tag for wall paper including a plate member and a springy-metal pronged wire which can be inserted into an open centre of the wall paper roll. U.S. Pat. No. 1,053,380 (Gray et al) discloses a tag for wall paper or the like which again provides a plate member and a spring wire which is wrapped around the plate member and leaves a portion which can extend into the centre of the roll. U.S. Pat. No. 1,865,908 (Hengst) discloses a tag for placing into the end of a bobbin which again comprises a flat plate member and a spring projection extending therefrom.

However each of these devices is generally not satisfactory for use in an office for files or drawings or the like since it does not have the ne essary flexibility and since in some cases it is too expensive to manufacture at a price which will be acceptable for large scale use.

SUMMARY OF THE INVENTION

It is one object of the present invention, therefore, to provide a visual marker which can be readily attached to the drawings and presents a marking face for receiving indicia the orientation of which can be adjusted to suit different positioning of the marker.

It is a further object of the present invention to provide a visual marker of this type which is manufactured simply and cheaply from a very limited number of parts and thus can be made available in large numbers at a relatively cheap price.

According to a first aspect of the invention, therefore, there is provided a visual marker for use in indicating or identifying rolled drawings or the like comprising a visual marker member defining a marker face for receiving indicia, a flexible spring member, and means coupling one end of the spring member to the marker member so that an opposed end of the spring member can extend rearwardly from the marker face, said spring member comprising a single planar closed loop having sides intermediate said ends having a transverse spacing greater than the transverse width of the ends whereby said opposed end can be inserted into the rolled drawings or the like and the sides can be compressed inwardly thereby so as to present said marker face forwardly from the drawings or the like.

According to a second aspect of the invention, therefore, there is provided a visual marker for use in indicating or identifying rolled drawings or the like comprising a visual marker member defining a marker face for receiving indicia, a single planar flexible spring closed loop member and means coupling one end of said loop member to the marker member so that an opposed end thereof can extend rearwardly from the marker face for engaging said drawings or the like and so as to present said marker face forwardly therefrom, said coupling means providing pivotal movement between said loop member and said marker member so the marker member can be moved from a first position in which it is folded flat substantially in the plane of the loop member to a second position in which the marker face is substantially at right angles thereto.

According to a third aspect of the invention, therefore, there is provided a visual marker for use in indicating or identifying rolled drawings or the like comprising a visual marker member defining a marker face for receiving indicia and a flexible spring loop member for extending rearwardly from said marker face for engaging said drawings or the like and for presenting said marker face forwardly therefrom, said marker member having press-fit opening means therein for receiving and retaining ends of said loop member whereby said loop member is closed by said marker member and forms a continuous loop extending rearwardly therefrom.

It is one advantage of the invention, therefore, that it can be manufactured simply from two parts, that is preferably a plastics marker part and preferably a spring wire spring member with the two coupled as a press-fit of the ends of the spring wire ino a boss on a rear face of the marker member.

This arrangement can provide a pivot coupling between the spring and the marker member which allows the marker member to be folded to a position with its face substantially in the plane of the spring so that it can be used in marking items in a pile of flat items such as paper in a file or files in a pile of files.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
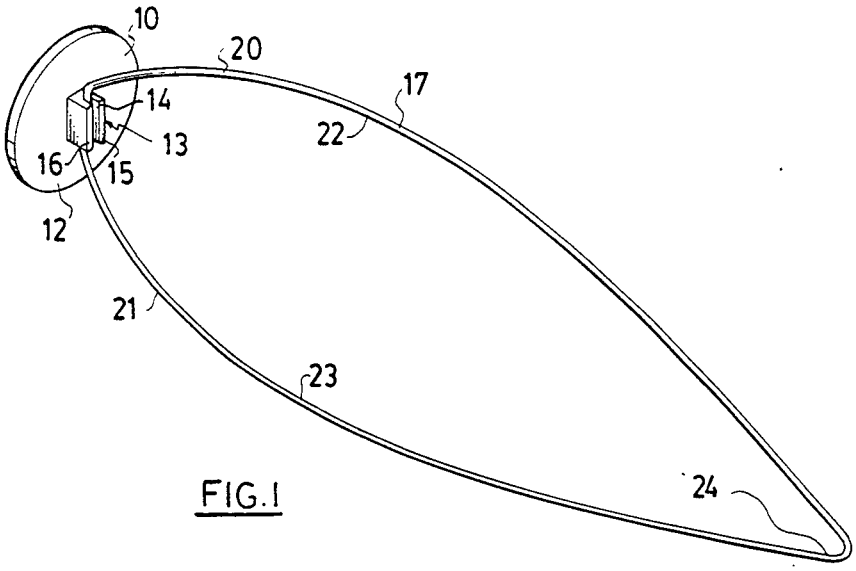
FIG. 1 is an isometric view of a visual marker according to the invention showing a rear face of the marker member and the spring loop attached thereto.
Figure 2:
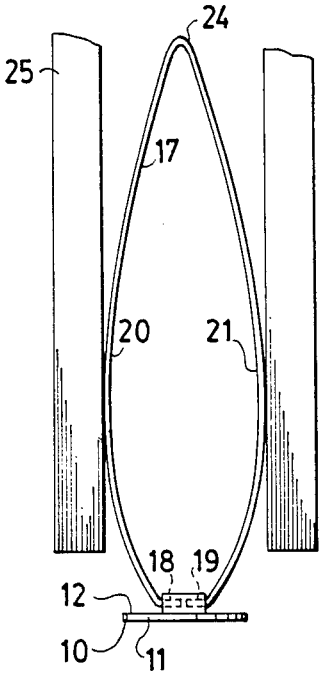
FIG. 2 is a plan view of the visual marker of FIG. 1 inserted into a rolled drawing.

The marker member comprises a planar disc 10 with a front face or marker face 11 and a rear surface 12. On the rear face is integrally formed a boss 13 in the form of a rectangular projection defining a slot 14 centrally thereof between a pair of plate members 15 and 16 which extend outwardly from the rear face 12 of the disc 10.

A spring wire loop 17 has ends 18 and 19 which are turned inwardly so as to lie in a single line and face one another for insertion into the slot 14. The spring wire 17 is formed of a circular cross section wire of suitable flexibility and material, preferably stainless steel, with a diameter slightly greater than the width of the slot 14 so that the insertion as a press-fit of the ends 18 and 19 into the slot acts to distort the boss 13 to retain the ends within the boss 13.

The ends project outwardly from the ends of the slot to join sides 20 and 21 of the spring wire which curve outwardly to a widest point 22, 23 and then to converge to an opposed end of the loop which is substantially pointed as indicated at 24.

The spring wire can thus be formed from a simple straight wire by a bending process leaving a high degree of flexibility in the sides, following which the ends can be inserted into the slot 14 to complete the marker as shown in FIG. 1.

Figure 3:
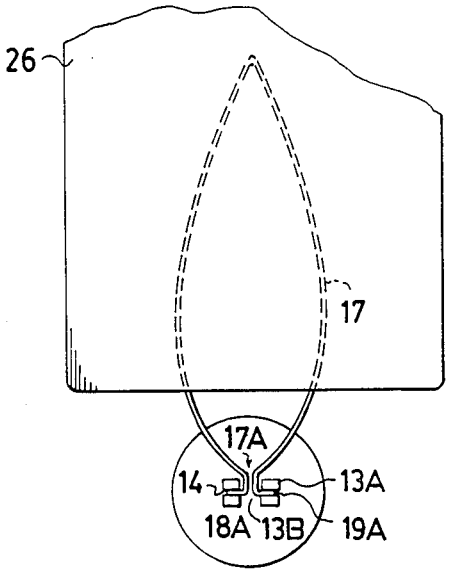
FIG. 3 is a plan view of a modified marker inserted into a stack of planar members such as papers in a file.

As the ends of the wire held in the slot 14 and thus closing the loop 17 project outwardly from the ends of the slot 14, the disc 10 can be pivoted about the axis defined by the ends 18 and 19 from a position in which the face 11 lies in a plane substantially at right angles to the plane of the loop 17 to a position shown in FIG. 3 in which the face 11 lies substantially in the same plane as the loop 17. In the first condition, the loop can be inserted into a rolled drawing as indicated at 25 with the pointed end 24 allowing simple entry into the end of the drawing regardless of the diameter to which it is rolled. The sides 20 and 21, when the loop 17 is fully inserted, engage the inner surfaces of the rolled drawing and are distorted inwardly thereby to retain the loop 17 by spring pressure within the drawing. The face 11 is thus presented outwardly of the end of the rolled drawing and faces axially for ready inspection of indicia carried on the front face identifying the drawing or providing any further information which may be required.

In FIG. 3 the disc is turned so that when the loop 17 is positioned horizontally within a stack 26 of, for example, papers, the face 11 can be presented upwardly ready for visual inspection of indicia carried thereon.

The embodiment of FIG. 3 is modified in that the ends of the wire loop 17 are bent outwardly rather than inwardly as indicated at 18A, 19A. The loop is thus bent so that the ends meet at a central position with the boss indicated at 13A divided by a central slot 13B to receive the central parts of the wire to accommodate the pivoting movement as previously described. This embodiment has the advantage that inward bending of the loop is taken up by distortion of the wire at the area indicated at 17A and avoids any tendency of the bending movement to work the ends 18A, 19A out of the slot 14.

In alternative arrangements which are not shown, the spring wire can be replaced by a molded or formed plastics spring which has effectively the same characteristics as the spring wire and is attached to the boss 13 in substantially the same manner. The formed plastics loop may have a cross section which is designed to provide the required flexibility, for example a T-shaped cross section, with the cross section varying if required, for example, at the ends for suitable insertion into the boss 13.

In a further embodiment (not shown) the loop is closed by a separate plastics piece applied at the end 24 with a straight portion between the sides 20 and 21 being received in the slot 14 in place of ends of the loop. Such an arrangement provides the possibility of a further surface in the connecting member at the end 24 for receiving further information, if required.

In a yet further arrangement, the spring loop may be molded integrally with the marker member and connected permanently thereto.

In all of these cases, the spring loop provides a simple planar single loop which can be simply inserted into the end of the tubular drawing or can be slid in between flat sheets.

The marker can also be used with other tubular items such as wall paper. The marker member can itself be shaped to form an indicium, for example, a logo, or could be colour coded. The boss can be of any suitable shape other than rectangular.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A visual marker for comprising a visual marker member molded from a synthetic plastics material defining a marker face on one surface of the member for receiving indicia, a flexible spring member formed from spring wire, and coupling means integrally molded on said marker member and extending outwardly therefrom from a face thereof opposite to said marker face, said coupling means engaging the spring member so that an end of the spring member remote from the marker member can extend in a longitudinal direction thereof generally rearwardly from the marker face, said spring member having first and second open ends attached to said coupling means and comprising a single planar closed loop extending from an end adjacent to said marker member defined by said first and second open ends to said remote end and having sides intermediate said adjacent and remote ends having a tranverse spacing greater than the transverse width of the adjacent and remote ends, said coupling means defining a pair of surfaces generally at right angles to said marker member and at right angles to said planar loop, each of said surfaces having an opening therein with said openings lying on a common axis for receiving as a press fit a respective one of said first and econd open ends, said first and second open ends being turned to lie on a common axis lying in a direction at right angles to said longitudinal direction whereby the spring member can pivot relative to said marker member about said common axis defined by said first and second ends and by said openings from a first position in which the marker face lies substantially in the plane of the spring member to a second position in which the marker face is substantially at right angles to the plane of the spring member.

2. A visual marker according to claim 1 wherein said remote end of said spring member converges from said sides substantially to a point.

3. A visual marker according to claim 1 wherein said openings in said surfaces of said coupling means are defined by a slot defined between a pair of rearwardly projecting plate members, said slot having a width less than a width of said spring member for receiving said spring member as a press-fit.

4. A visual marker according to claim 1 wherein said first and second ends of said spring member are turned outwardly so as to lie in a common line parallel to the marker face about which line the loop member can pivot relative to said marker member.

5. A visual marker according to claim 4 wherein said marker member includes means defining a pair of slots spaced to leave an area between the slots in which said ends can pivot.

6. A visual marker for comprising a visual marker member molded from a synthetic plastics material defining a marker face on one surface of the member for receiving indicia, a flexible spring member formed from spring wire, and coupling means integrally molded on said marker member and extending outwardly therefrom from a face thereof opposite to said marker face, said coupling means engaging the spring member so that an end of the spring member remote from the marker member can extend in a longitudinal direction thereof generally rearwardly from the marker face, said spring member having first and second open ends attached to said coupling means and comprising a single planar closed loop extending from an end adjacent to said marker member defined by said first and second open ends to said remote end and having sides intermediate said adjacent and remote ends having a transverse spacing greater than the transverse width of the adjacent and remote ends, said coupling means defining a pair of surfaces generally at right angles to said marker member and at right angles to said planar loop, each of said surfaces having an opening therein with said openings lying on a common axis for receiving as a press-fit a respective one of said first and second open ends, said first and second open ends being turned to lie on a common axis lying in a direction at right angles to said longitudinal direction whereby the spring member can pivot relative to said marker member about said common axis defined by said first and second ends and by said openings from a first position in which the marker face lies substantially in the plane of the spring member to a second position in which the marker face is substantially at right angles to the plane of the spring member.

* * * * *